US009279198B2

(12) United States Patent
Carrara et al.

(10) Patent No.: US 9,279,198 B2
(45) Date of Patent: Mar. 8, 2016

(54) YARNS FOR PROTECTIVE GARMENTS AND MANUFACTURING METHODS THEREOF

(71) Applicant: FILTES INTERNATIONAL S.r.l., Capriolo (IT)

(72) Inventors: Sergio Carrara, Brescia (IT); Giuliano Gandossi, Brescia (IT)

(73) Assignee: FILTES INTERNATIONAL S.r.l., Capriolo, Brescia (IT)

( * ) Notice: Subject to any disclaimer, the term of this patent is extended or adjusted under 35 U.S.C. 154(b) by 267 days.

(21) Appl. No.: 13/919,011

(22) Filed: Jun. 17, 2013

(65) Prior Publication Data

US 2014/0000750 A1 Jan. 2, 2014

(30) Foreign Application Priority Data

Jun. 29, 2012 (IT) ..... BS2012A0098

(51) Int. Cl.

| | |
|---|---|
| ***D02G 3/38*** | (2006.01) |
| ***D02G 3/44*** | (2006.01) |
| ***D03D 15/00*** | (2006.01) |
| ***D02G 3/36*** | (2006.01) |

(52) U.S. Cl.

CPC ..... *D02G 3/38* (2013.01); *D02G 3/365* (2013.01); *D02G 3/367* (2013.01); *D02G 3/385* (2013.01); *D02G 3/442* (2013.01); *D03D 15/0027* (2013.01)

(58) Field of Classification Search

CPC ..... D02G 3/04; D02G 3/12; D02G 3/185; D02G 3/36; D02G 3/362; D02G 3/365; D02G 3/367; D02G 3/38; D02G 3/385; D02G 3/442

USPC ..... 57/24, 203, 229, 230

See application file for complete search history.

(56) References Cited

U.S. PATENT DOCUMENTS

| | | | | |
|---|---|---|---|---|
| 2,211,790 | A * | 8/1940 | Pile | 74/502.6 |
| 4,470,251 | A | 9/1984 | Bettcher | |
| 4,849,038 | A * | 7/1989 | Burghardt et al. | 156/172 |
| 5,644,907 | A * | 7/1997 | Kolmes et al. | 57/230 |
| 5,845,476 | A * | 12/1998 | Kolmes | 57/229 |
| 6,016,648 | A * | 1/2000 | Bettcher et al. | 57/230 |
| 6,127,035 | A * | 10/2000 | Carter et al. | 428/377 |
| 6,260,344 | B1 * | 7/2001 | Chakravarti | 57/230 |
| 6,266,951 | B1 * | 7/2001 | Chakravarti | 57/210 |
| 6,467,251 | B1 | 10/2002 | Kolmes | |
| 6,532,724 | B2 * | 3/2003 | Patrick | 57/229 |
| 6,581,366 | B1 * | 6/2003 | Andrews | 57/225 |

(Continued)

FOREIGN PATENT DOCUMENTS

| | | | |
|---|---|---|---|
| EP | 1964952 | A1 | 9/2008 |
| WO | 9855676 | A1 | 12/1998 |
| WO | 03018890 | A1 | 3/2003 |
| WO | WO 2011037070 | A1 * | 3/2011 |

*Primary Examiner* — Shaun R Hurley

(74) *Attorney, Agent, or Firm* — Robert E. Alderson, Jr.

(57) ABSTRACT

Yarns are provided which may include a core having a continuous filament, a first covering of said filament, obtained by winding a first yarn in a first winding direction, a second covering superposed over the first covering, made by winding a second yarn in an opposite winding direction, so as to form an open-coiling cover, at least one third covering, obtained by winding at least one sliver having discontinuous fibers in the same winding direction as the second yarn, positioning the fibers at least in the interspaces of said open-coiling cover. Durable and comfortable textiles and garments made from such yarn and methods of making same are also provided.

15 Claims, 3 Drawing Sheets

(56) References Cited

U.S. PATENT DOCUMENTS 8,671,816 B2 * 3/2014 Yanagita ..... 87/13
2003/0074879 A1 * 4/2003 Patrick ..... 57/229
2004/0148921 A1 * 8/2004 Guevel et al. ..... 57/229
2005/0086924 A1 * 4/2005 Kolmes ..... 57/229

* cited by examiner

YARNS FOR PROTECTIVE GARMENTS AND MANUFACTURING METHODS THEREOF

CROSS REFERENCE TO RELATED APPLICATION

This application claims priority to and benefit of Italian Patent Application No. BS2012A000098 filed Jun. 29, 2012, the contents of which are incorporated by reference in their entirety.

FIELD OF THE INVENTION

The present invention relates to yarns for protective garments, i.e. yarns having high mechanical resistance and wear properties, called "technical" yarn in the field, such as those used for making textiles for manufacturing work gloves or other safety garments.

BACKGROUND OF THE INVENTION

Several types of technical yarns exist. For example, document U.S. Pat. No. 4,777,789 describes a yarn consisting of an inner core formed by a single or multi-filament, on which an inner yarn is superposed, for example made of stainless steel. The core and the inner yarn are covered with a first yarn wound in a first winding direction which forms a first covering layer; the first covering layer is covered with a second yarn wound in a second winding direction which forms a second covering layer.

Further examples of yarn are described in documents EP1486595A1 and U.S. Pat. No. 4,495,760A.

SUMMARY OF THE INVENTION

The present invention provides new types of yarns, having excellent mechanical features, which are more suitable than known yarns for making technical textiles, especially for protective garments.

In particular, yarns provided by the present invention show a high resistance to blade-shearing and to abrasion, exhibit considerable machinability in weaving the garments and are very comfortable when worn by the user.

The present invention shall now be described in detail, with the aid of the accompanying drawings, described briefly below.

DETAILED DESCRIPTION

Figures 1, 2A, 2B:
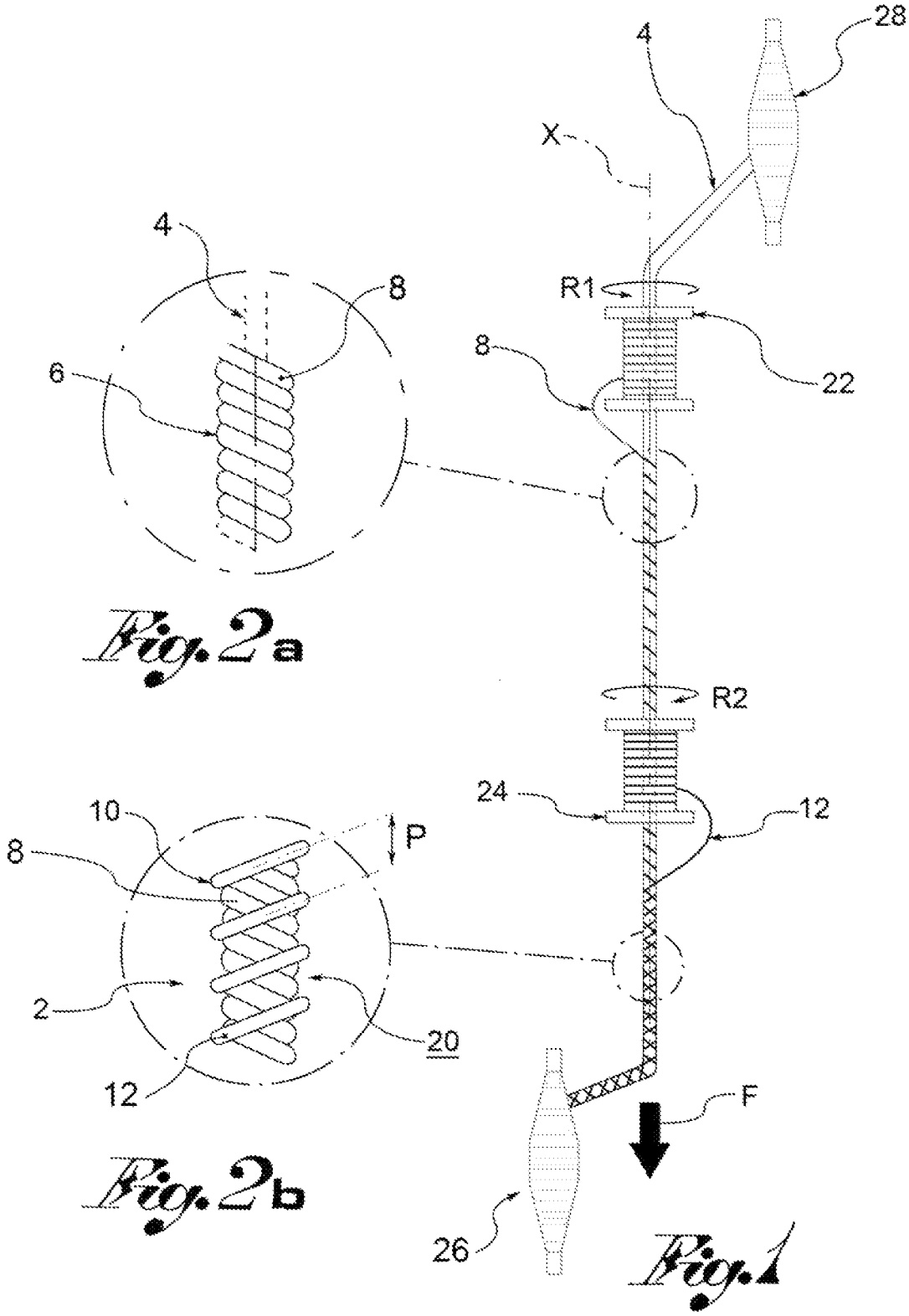
FIG. 1 shows a production scheme according to an embodiment of the present invention.
FIGS. 2*a* and 2*b* show two enlargements of the zones highlighted in FIG. 1.

With reference to the above figures, reference numeral 1 globally indicates yarns.

In certain embodiments, yarns according to the present invention have sufficient abrasion resistance and shearing resistance features and transpirability and comfort properties so as to make it especially suitable for manufacturing protective garments or textiles for manufacturing such garments. High comfort also results from the low hairiness of the yarn used since, as discussed hereinafter, the component fibres thereof remain firmly blocked at multiple points.

In certain embodiments yarns according to the invention are particularly well-sorted for manufacturing protective gloves.

Yarn 1 may include a core 2 which extends along a core axis X and which may include at least one continuous filament 4.

Continuous filament 4 may include at least one glass, steel and/or ceramic filament.

The continuous filament may include a high molecular weight polyethylene filament or an aramid filament. In certain embodiments, aramid filaments may include any one of the materials known by the trade names Dyneema®, Kevlar® or Technora®.

In other embodiments, a discontinuous filament may be provided in place of or in addition to the continuous filament. In certain embodiments such filament will have a high shearing resistance in order to provide protective features to the yarn. The composition of such filament may be that described with reference to the continuous filament 4.

Therefore, a single filament or a plurality of separate filaments may be used as continuous filament, optionally different in composition/nature as mentioned above.

According to a further embodiment, the continuous filament 4 may have a linear density in the range 22-2200 dtex, in certain embodiments 40-1600 dtex, and in other embodiments 40-680 dtex.

Core 2 may include a first covering 6 of filament 4, obtained by winding a first yarn 8 in a first winding direction $R_1$ (for example with an S-type twisting) with a first number of windings per linear meter $NW_1$, and a second covering 10 superposed over the first covering 6, made by winding a second yarn 12 in a second winding direction $R_2$, opposite the first direction $R_1$ (for example with a Z-type twisting), with a second number of windings per linear meter $NW_2$ so as to form an open-coiling cover 20.

In this way, the first and the second covering enclose at least partly the continuous filament 4, and the second covering 10 creates a plurality of interspaces in said open-coiling cover 20, i.e. spaces delimited between each pair of adjacent coils of such covering 10.

With reference to the scheme shown in FIG. 1, the continuous filament 4 may be fed in a feeding direction F, from top downwards, through a core reel 28. During such feeding, the first yarn 8 may be first fed by twisting in the first direction $R_1$ (for example by a first hollow spindle 22), and then the second yarn 12 may be placed to partly cover the first covering 6. The second yarn 12 may be applied in the opposite second winding direction $R_2$, for example by a second hollow spindle 24. Finally, once core 2 has been completed as said above, it may be collected on a gathering reel 26 which can be used for feeding in the subsequent production step of the yarn.

The first yarn 8 may form a closed-coiling cover; in other words, according to this variant, the yarn of the first covering 6 may form a continuous layer which fully covers filament 4 since the coils of that yarn 8 are axially tangent to one another, so as not to leave any spaces therebetween from which the continuous filament 4 (and optionally an underlying first layer or intermediate winding) emerges.

In certain embodiments, the first yarn 8 may have a linear density in the range 22-2200 dtex, in certain embodiments 40-1600 dtex, and in other embodiments 40-680 dtex. According to a further variant, the second yarn 12 may have a linear density in the range 22-2200 dtex, in certain embodiments 40-1600 dtex, and in other embodiments 40-680 dtex.

The first yarn 8 may be of the same type as the second yarn 12. In other words, this variant provides for the first 8 and the second 12 yarn to be identical or similar, so as to carry out the same function or work.

In said core 2, the second number of windings $NW_2$ is smaller than the first number of windings $NW_1$.

In this way, due to the unbalance in the number of windings between the two winding directions, core 2 has residual inner tensions.

For example, the first number of windings $NW_1$ is more than about 100 turns/meter, and in certain embodiments more than 200 turns/meter. Advantageously, the first number of windings $NW_1$ may be smaller than about 1000 turns/meter, suitably equal to or less than 900 turns/meter. In certain embodiments such windings may be about 900, 800 or 600 turns/meter.

The first number of windings per linear meter $NW_1$ may be about 3-7 times the second number of windings per linear meter $NW_2$.

For example, the first number of windings per linear meter $NW_1$ of the first yarn 8 may be about 600 turns/meter while the second number of windings per linear meter $NW_2$ of the second yarn 12 may be about 200 turns/meter.

According to certain embodiments, the first covering 6 and the second covering 10 may be in direct contact with each other. According to a further embodiment (not shown), at least said first layer or intermediate winding is provided between the first 6 and the second 10 covering.

Yarn 1 further may include at least one third covering 14 obtained by winding at least one sliver 16', 16" including discontinuous fibres 18 in the same winding direction $R_2$ as the second yarn 12 (for example with a Z-type twisting) so as to position said fibres 18 at least in the interspaces of said open-coiling cover 20.

In fact, as mentioned above, the second covering 10 leaves some interspaces within the open-coiling cover 20, while the first yarn 8 preferably forms a closed-coiling cover.

Therefore, due to the twisting of sliver 16', 16" in the direction opposite to the first covering 6, the application of the third covering 14 provides additional effects which may include:

i) the entry of the discontinuous fibres 18 at least in the interspaces of the open-coiling cover 20;

ii) the at least partial seating of such fibres 18 between the coils of the first covering 6, which are enlarged due to the twisting of core 2; and iii) the locking of the discontinuous fibres 18 by the coils of the second covering 10 which are axially tightened.

In other words, the presence of a second yarn 12 and of a sliver wound in the same winding direction provides important technical advantages, since the first and the second covering are thus suitable for holding the discontinuous fibres 18 present. In fact, the sliver is suitable for penetrating and being blocked by the first covering, since the tails of fibres 18 previously placed on the first covering are stopped by the heads of the fibres that thereafter arrive onto core 2, thus forming a substantially tubular structure which surrounds the yarn core.

Accordingly, substantially all the discontinuous fibres remain firmly blocked on the core so that the degree of hairiness, both perceived by the user of the textile or garment and the actual one, is substantially nil.

Figure 4:
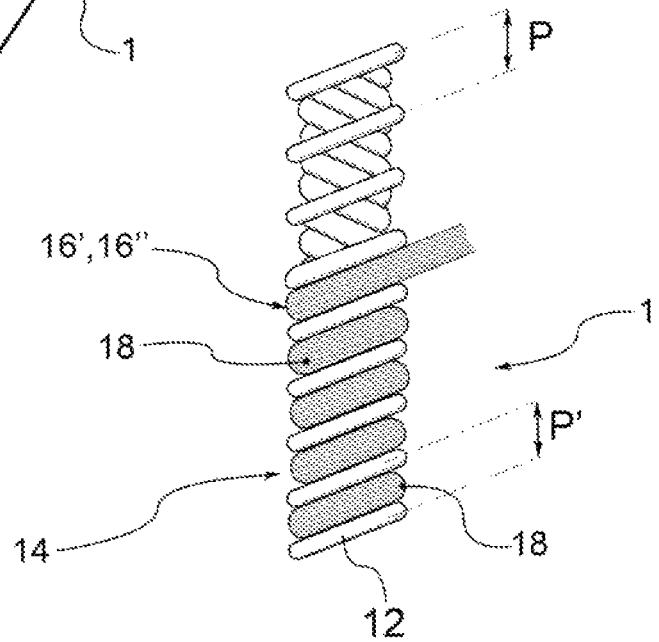
FIG. 4 shows an enlargement of the zone highlighted in FIG. 3.

Concerning the above effect iii), the representations in FIGS. 2*b* and 4 for example may be compared. In the second of the above figures, it may be seen that the pitch of the windings of the second yarn 12 is decreased as compared to the condition in which the sliver was not wound about the continuous filament (FIG. 2*b*).

For example, making a geometrical comparison, defining with symbol P the pitch of the coils (FIG. 2*b*) of the second yarn 12 after the creation of core 2, and with symbol P' the distance between contiguous coils after the winding of the at least one sliver 16', 16", the following relation should always apply:

$$P>P'$$

The third covering 14 also may be partly above the second covering 10, so sliver 16', 16" not only is inserted in the above interspaces but at least partly, if not completely, covers also the windings of the second yarn 12.

In this way, according to certain embodiments, sliver 16', 16" forms a closed tubular cladding (i.e. covering or lining) on core 2.

According to a further variant, sliver 16', 16" may form an axially discontinuous tubular cladding so that the coils of the second covering 10 partly emerge from such tubular cladding.

The third covering 14 may be made by rotating core 2 about its longitudinal extension to reduce the breadth of the interspaces in the open-coiling cover 20; accordingly, since such twisting is imposed downstream of the coupling station 32 described below, and in particular downstream of the pair of rolls A-B (FIGS. 3 and 5), the discontinuous fibres 18 may be twisted while they arrive on core 2. Therefore, from the substantially flat shape with which they exit the cylinders, they take on a generically cylindrical shape which is retained/pinched by core 2 in a plurality of discrete points as described above.

According to an embodiment, sliver 16', 16" may have a linear density in the range 22-2200 dtex, in certain embodiments 40-1600 dtex, and in other embodiments 40-680 dtex.

For example, the second covering 10 and the third covering 14 may be in direct contact with each other. Alternatively, however, at least one second layer or intermediate winding may be provided.

Optionally, the third covering 14 may comprise, in addition to sliver 16', 16", at least one third continuous filament yarn with the same number of windings as said sliver 16', 16".

According to different variants which also may be implemented at the same time, the third yarn (or plurality thereof) may have elastic properties, flame-retardant properties, high gliding and/or flame-resistant properties.

According to different embodiments, the first and the second yarn (and also the third yarn, where provided) may be independently chosen between continuous filament yarns or discontinuous filament yarns.

The third covering 14 may include a pair of discontinuous filament slivers 16', 16".

Figure 3:
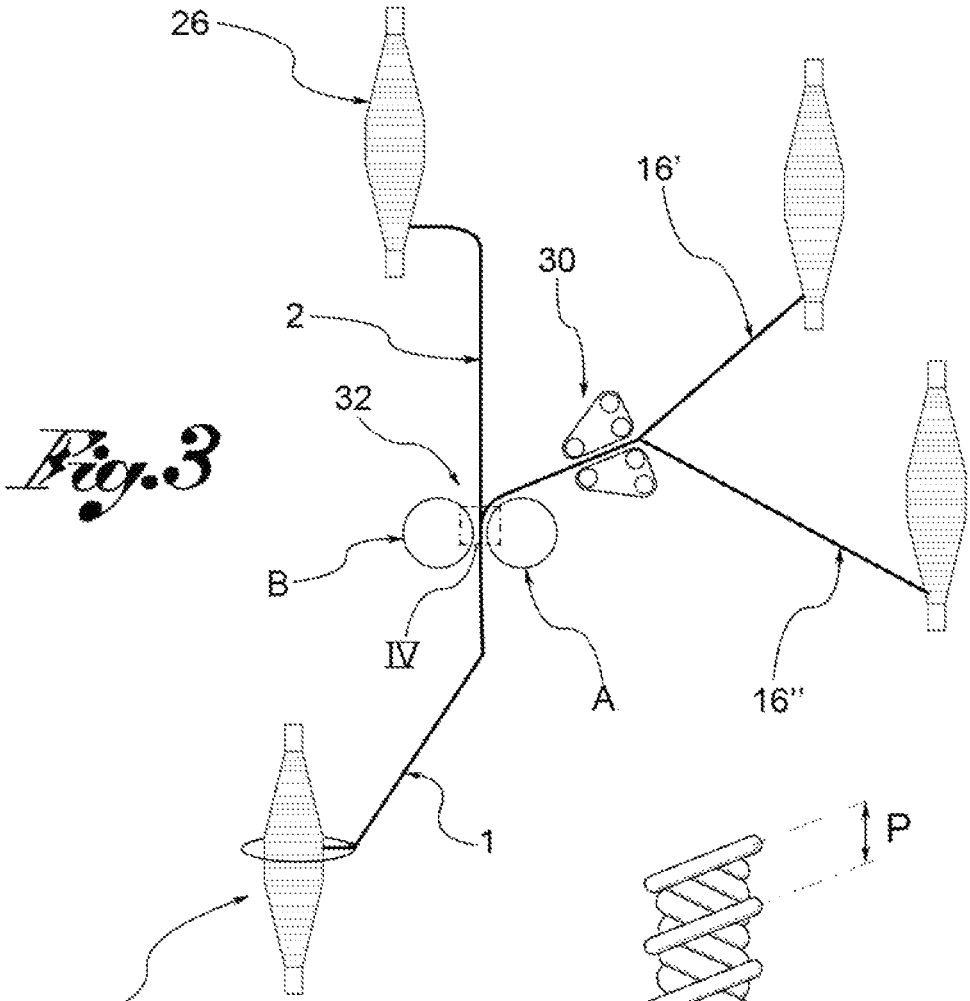
FIG. 3 shows a production scheme according to a further embodiment of the invention.
Figure 5:
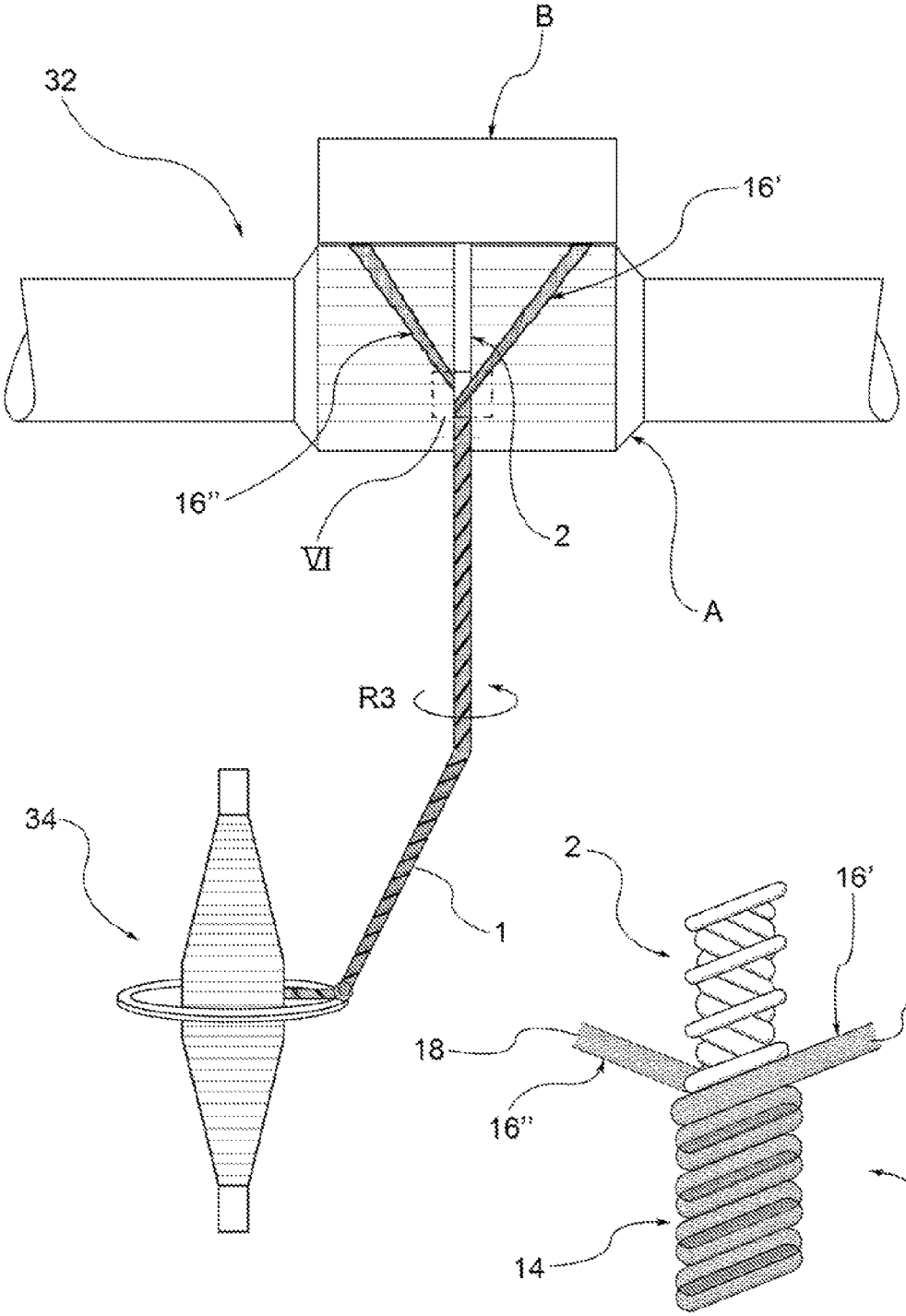
FIG. 5 shows a front view of the coupling station at the end of the production process for yarns according to embodiments of the invention.
Figure 6:
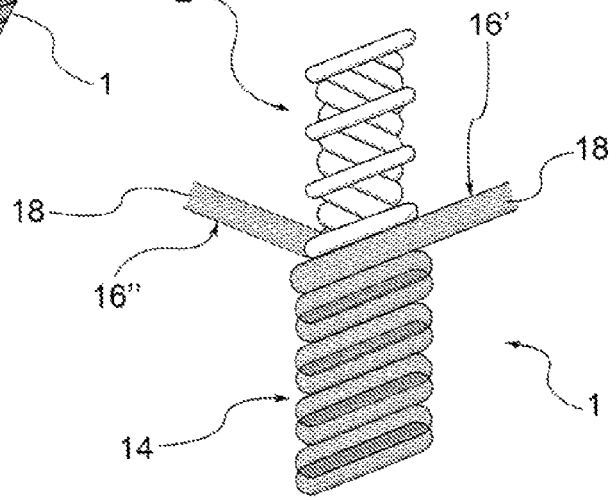
FIG. 6 shows an enlargement of the zone highlighted in FIG. 5 in the coupling zone of the pair of slivers according to a further variant.

Referring for example to the embodiment shown in FIGS. 3 and 5, core 2 and the pair of discontinuous filament slivers 16', 16" may converge in a coupling station 32 arranged downstream of the stretching unit 30 of a spinning frame.

Such station 32 may include of a pair of rolls A-B, one of which (marked with letter A) may be motor driven. The driven roll B, on the other hand, may rest on the motor driven roll A for exerting a compression force.

In particular, slivers 16', 16" may be fed from opposite sides of core 2 so as to converge on the latter. Advantageously, the slivers may be therefore fed in parallel, so that they arrive on core 2 substantially at the same axial point of the latter.

The compression of rolls A-B therefore can make a tension set downstream of the coupling station 32, due to the rotation of core 2 in a third direction of rotation $R_3$, caused for example by a ring spindle 34.

Accordingly, the twisting of core 2 can make the pair of slivers 16', 16" envelope about it, and further cause a re-approach of the coils of the second covering 10 so that it retains/pinches the discontinuous fibres 18 together with the first covering 6, constraining them to yarn 1.

Moreover, in creating the third covering, the discontinuous fibres 18 arrange in a cylindrical fashion as discussed above.

According to further variants, irrespective of the filament chosen, the first yarn 8, the second yarn 12, the sliver 16', 16", and optionally also the third yarn, may be independently selected from the group including in polyethylene, polyamide, polyester, (para-)aramid and high molecular weight polyethylene and blends thereof.

According to further variants, the first yarn 8, the second yarn 12, the sliver 16', 16", and optionally also the third yarn, may be independently selected from natural fibres, such as cotton, wool, etc. and blends thereof, and optionally mixed with the synthetic fibres or filaments described above.

According to a another variant, the sliver 16', 16" has a number of windings per linear meter $NW_3$ such that the following equation applies:

$$NW_1-NW_3\approx NW_2+NW_3$$

where symbol "≈" indicates a tolerance suitable for partly reducing (or even eliminating) the residual inner tensions generated in the core.

In fact, as will implicitly be appreciated from the above description, the twisting value in the yarn may be determined so as to obtain a generic or substantial balancing of the twisting values of the yarn that surround the core, per se unbalanced, so as to balance it again.

For example, going back to the previous numerical example, since a variant provides for the number of windings per linear meter $NW_3$ of sliver 16', 16" to be about 200 turns/meter, such value adds up to the number of windings $NW_2$ of the second yarn in the same direction $R_2$, which is about 200 turns/meter. The total of such sum therefore is about 400 turns/meter.

On the other hand, as regards the first yarn 8, where the windings have been created in the opposite winding direction $R_1$, from the greater number of windings per linear meter $NW_1$ (about 600 turns/meter) it is necessary to subtract the number of windings $NW_3$ of sliver 16', 16" (200 turns/meter), thus obtaining the value of about 400 turns/meter, which is identical to the value of windings in the second direction $R_2$.

Accordingly, according to this variant, the inner tensions are substantially eliminated.

Advantageously, the tolerance with which symbol "≈" must be interpreted may be expressed by the following equation:

$$0.50\leq(NW_1NW_3)/(NW_2+NW_3)\leq1.50.$$

In certain embodiments, the ratio is in the range of 0.60-1.40 and in other embodiments in the range of 0.70-1.30.

In other embodiments, such tolerance value may be as follows:

$$0.90\leq(NW_1NW_3)/(NW_2+NW_3)\leq1.10.$$

which corresponds to the equality of equations $NW_1-NW_3=NW_2+NW_3$ with a variability of about 50%, 40%, 30% or 10%, respectively.

The invention further provides textiles and garments made at least partially with yarn 1 according to any of the embodiments described herein.

According to one embodiment, such textiles may be a single-layer made with yarn 1 described with reference to previous variants, and with a secondary yarn made of a "comfort" material, such as a cellulose and/or polyamide material.

In particular, such secondary yarn is a yarn suitable for improving the breathability and the wearability of said textile/garment since it preferably is more breathable than yarn 1.

According to certain variants, the secondary yarn may include discontinuous fibres.

According to a further variant, the secondary yarn may include high molecular weight polyethylene and/or an aramid filament.

According to an even further variant, the secondary yarn may include cellulose and/or a polyamide.

The secondary yarn also may include high molecular weight polyethylene and/or an aramid filament and at least one of cellulose and a polyamide, for example in variable percentages.

The two yarns may be woven so as to define at least two separate portions through the textile thickness: thus, there may be a first portion having a preponderance of yarn 1, and a second portion having a preponderance of the secondary yarn, where such portions are at least partly twisted.

Document EP1675487A1 describes potential methods for obtaining separate portions of the above-described layering.

For example, an embodiment provides for the first portion to be facing "outwards" (i.e. on the opposite side with respect to the skin of the textile or garment's user), and a further embodiment provides for the second portion to be facing "inwards", in contact with or facing towards the user, due to the increased comfort that such portion offers when placed in contact with the skin.

According to an even further variant, the second portion may include, in addition to the secondary yarn, an at least partly elastic yarn.

The present invention further provides methods of making a yarn 1 which may include:

providing at least one continuous filament 4;

winding a first yarn 8 in a first winding direction $R_1$ with a first number of windings per linear meter $NW_1$ to obtain a first covering 6 of said filament 4;

winding a second yarn 12 in a second winding direction $R_2$, opposite the first $R_1$, with a second number of windings per linear meter $NW_2$, so as to superpose a second covering 10 with an open-coiling cover 20 on the first covering 6 and thereby form a core 2, where the second number of windings $NW_2$ is lower than the first number of windings $NW_1$; and creating at least one third covering 14 of core 2 by winding at least one sliver 16', 16" including discontinuous fibres 18 in the same winding direction $R_2$ as the second yarn 12 so that said fibres 18 penetrate in the interspaces of the open-coiling cover 20, where formation of the third covering 14 entails a distancing of the coils of the first covering 6 and a reduction of the interspaces of the open-coiling cover 20 to receive and retain fibres 18.

Such methods advantageously may include manufacturing steps as can be appreciated from the structure of the yarn according to any of the embodiments described herein.

In particular, one embodiment provides for sliver 16', 16" to have a number of windings per linear meter $NW_3$ such that the following equation applies:

$$NW_1-NW_3\approx NW_2+NW_3,$$

and in particular such that:

$$0.50 \leq (NW_1 - NW_3)/(NW_2 + NW_3) \leq 1.50.$$

Moreover, the step of creating the third covering 14 may include a step of winding a pair of discontinuous filament slivers 16', 16", for example, as schematised in the attached drawings.

According to a further advantageous variant, the step of creating a third covering 14 may include a step of winding, in addition to sliver 16', 16" or to the plurality thereof, at least one third continuous filament yarn with the same number of windings $NW_3$ as said sliver 16', 16".

The step of creating the third covering 14 may include a step of rotating core 2 to reduce the breadth of the interspaces of the open-coiling cover 20.

According to certain embodiments, the step of creating the third covering 14 may include a step of converging a pair of slivers 16', 16" on core 2 on opposite sides.

Accordingly, slivers 16', 16" may be fed in parallel, making them arrive on core 2 from opposite sides relative to the core axis X.

Moreover, a further embodiment provides for slivers 16', 16" to be arranged on the core at diametrically opposite zones. In fact, as may be seen for example in FIG. 5, the first sliver 16' is arranged above the core while the second sliver 16" is beneath.

According to further embodiments, the pair of slivers 16', 16" may converge on core 2 substantially at the same axial point thereof, taking the core axis X as a reference.

Non-limiting representative yarns according to the present invention are shown below, each with related resistance tests.

EXAMPLES

A. Yarns with Final Titre Nm 28/1 (dtex 357)

TABLE 1

| Yarn | Core (165 dtex) | | | | |
|---|---|---|---|---|---|
| no. | Cont. filament | I yarn | II yarn | Sliver | Sliver |
| 1 | glass (55 dtex) 34% | PES (55 dtex) 33% | PES (55 dtex) 33% | UHMWPE (92 dtex) 50% | PA (92 dtex) 50% |
| 2 | glass (55 dtex) 34% | PES (55 dtex) 33% | PES (55 dtex) 33% | UHMWPE (184 dtex) 100% | — |

B. Yarns with Final Titre Nm 14/1 (dtex 714)

TABLE 2

| | Core (220 dtex) | | | | |
|---|---|---|---|---|---|
| Yarn no. | Cont. filament | I yarn | II yarn | Sliver | Sliver |
| 3 | glass (110 dtex) 50% | PES (55 dtex) 25% | PES (55 dtex) 25% | UHMWPE (494 dtex) 100% | — |
| 4 | glass (110 dtex) 50% | PES (55 dtex) 25% | PES (55 dtex) 25% | AR (494 dtex) 100% | — |

Yarns were prepared according to the above tables, where abbreviations correspond to PES=polyester, UHMWPE=high molecular weight polyethylene, AR=para-aramid, PA=polyamide.

With reference to yarns having compositions according to the above table, below are the results of the tests to which gloves entirely made with such yarns were subjected, and related results:

TABLE 3

| Yarn no. | Abrasion resistance | Blade shear resistance |
|---|---|---|
| 1 | Level 4 | Level 5 |
| 2 | Level 5 | Level 5 |
| 3 | Level 5 | Level 5 |
| 4 | Level 5 | Level 5 |

As may be seen from the above tests (carried out according to the UNI EN388:2004 standard) the protective garments made according to the present invention must be considered high performance garments based on both types of testing.

Level 4 in the abrasion resistance test actually corresponds to about 8,000 cycles carried out with no defections of the glove.

Level 5 in the blade shear resistance tests corresponds to the maximum coefficient provided by the standard.

In addition to increased robustness the textile and the corresponding garment are also very comfortable.

In fact, the present yarn allows comfortable and breathable textiles to be obtained. This is an important technical effect since a highly resistant but non breathable garment would not be comfortable. Thus the present yarn allows excellent results to be obtained from both points of view.

A person skilled in the art based on the above description may make modifications to the yarns, textiles, garments and methods and still fall within the scope of the claims either literally or under the doctrine of equivalents.

In addition, each variant described as belonging to an embodiment may be implemented independently of the other variants described.

The invention claimed is:

1. A yarn comprising:

a core which comprises:

i) at least one continuous or discontinuous filament;

ii) a first covering of said filament, obtained by winding a first yarn in a first winding direction with a first number of windings ($NW_1$) per linear meter; and iii) a second covering superposed over the first covering, made by winding a second yarn in a second winding direction, opposite the first, with a second number of windings ($NW_2$) per linear meter, so as to form an open-coiling cover;

where the second number of windings is lower than the first number of windings; and at least one third covering, obtained by winding at least one sliver comprising discontinuous fibers in the same winding direction as the second yarn, positioning said fibers at least in the interspaces of said open-coiling cover;

the formation of the third covering entailing a distancing of the coils of the first covering and a reduction of the interspaces of the open-coiling cover to receive and retain said fibers.

2. The yarn of claim 1, wherein said sliver has a third number of windings ($NW_3$) per linear meter such that the following equation applies:

$$0.50 \leq (NW_1 - NW_3)/(NW_2 + NW_3) \leq 1.50.$$

3. The yarn of claim 1, wherein the first number of windings per linear meter is about 3-7 times the second number of windings per linear meter.

4. The yarn of claim 1, wherein the first covering, the second covering and the third covering are in direct contact with each other.

5. The yarn of claim 1, wherein the sliver forms a closed tubular cladding on the core.

6. The yarn of claim 1, wherein the third covering comprises a pair of slivers.

7. The yarn of claim 1, wherein the third covering comprises, in addition to the sliver, at least one third continuous filament yarn with the same number of windings as said sliver, said third yarn having elastic properties or flame-retardant/resistant properties.

8. The yarn of claim 1, wherein the first yarn, the second yarn and the sliver are independently selected from the group consisting of polyamide, polyester, (para-)aramid, polyethylene, high molecular weight polyethylene, natural fibers and blends thereof.

9. A textile or garment comprising the yarn of claim 1.

10. The textile of claim 9 comprising a single-layer and a secondary yarn comprising comfort material, the two yarns being woven so as to define at least two separate portions through the textile thickness, a first portion being in preponderance, yarn and a second portion being in preponderance, the secondary yarn, said portions being at least partially woven.

11. A method of making a yarn comprising the steps of:

providing at least one continuous filament;

winding a first yarn in a first winding direction with a first number of windings ($NW_1$) per linear meter to obtain a first covering of said filament;

winding a second yarn in a second winding direction, opposite the first, with a second number of windings ($NW_2$) per linear meter, so as to superpose a second covering with an open-coiling cover on the first covering and thereby form a core;

where the second number of windings is lower than the first number of windings; and creating at least one third covering of the core by winding at least one sliver comprising discontinuous fibers in the same winding direction as the second yarn so as to position said fibers at least in the interspaces of said open-coiling cover;

the formation of the third covering entailing a distancing of the coils of the first covering and a reduction of the interspaces of the open-coiling cover to receive and retain said fibers.

12. The method of claim 11, wherein the sliver has a number of windings per linear meter ($NW_3$) such that the following equation applies:

$$0.70 \leq (NW_1 - NW_3)/(NW_2 + NW_3) \leq 1.30.$$

13. The method of claim 11, wherein the step of creating the third covering comprises a step of rotating the core to reduce the breadth of the interspaces of the open-coiling cover.

14. The method of claim 11, wherein the step of creating the third covering comprises a step of causing a pair of slivers to converge on the core from opposite sides, the pair of slivers substantially converging at the same axial point of the core.

15. The method of claim 11, wherein the step of creating the third covering comprises a step of winding, in addition to the sliver, at least one third continuous filament yarn with the same number of windings as said sliver.

* * * * *